United States Patent [19]

Presser

[11] 4,182,258

[45] Jan. 8, 1980

[54] WATER SKI TOW HANDLE

[76] Inventor: Dwight W. Presser, 3148 Middlebelt, W. Bloomfield Township, Huron County, Mich. 48033

[21] Appl. No.: 969,876

[22] Filed: Dec. 15, 1978

Related U.S. Application Data

[63] Continuation of Ser. No. 835,912, Sep. 23, 1977, abandoned.

[51] Int. Cl.[2] ..... A63C 11/10

[52] U.S. Cl. ..... 115/6.1

[58] Field of Search ..... 115/6.1; 16/111 R, 111 A, 16/112; 272/61, 67, 117, 118, 143, 144; 273/81 R, 81 B; 114/90; 9/310 A

[56] References Cited

U.S. PATENT DOCUMENTS

| | | | |
|---|---|---|---|
| 1,677,099 | 7/1928 | Harness | 273/81 B |
| 2,871,899 | 2/1959 | Coyle et al. | 273/81 R |
| 3,092,068 | 6/1963 | Brownson | 115/6.1 |
| 3,219,348 | 11/1965 | Dishner, Jr. | 273/81 B X |
| 3,537,418 | 11/1970 | Brownson | 115/6.1 |
| 3,734,049 | 5/1973 | Humbert | 115/6.1 |
| 3,795,215 | 3/1974 | Butler | 114/90 |

*Primary Examiner*—Sherman D. Basinger

*Attorney, Agent, or Firm*—Barnes, Kisselle, Raisch & Choate

[57] ABSTRACT

A tow rope handle for water skiing or the like comprising an elongated hand grip with a pair of spaced holes extending transversely therethrough and a tow line threaded through each spaced hole and formed in a loop firmly to encircle the hand grip. The hand grip is substantially three-sided and bounded by an isosceles triangle in transverse cross section.

13 Claims, 5 Drawing Figures

WATER SKI TOW HANDLE

This is a continuation of application Ser. No. 835,912, filed Sept. 23, 1977 now abandoned.

The present invention relates to rope handles, and particularly to a tow rope handle specifically adapted for use in water skiing or the like.

Typical prior art water ski tow rope handles are disclosed in the following U.S. Pat. Nos. Brownson 3,092,068 and 3,537,418, Stein 3,695,210, Beck 3,930,460 and Holland 4,043,290.

It is an object of the present invention to provide a rope handle which is economical to manufacture and assemble, which is durable in operation, compact and neat in appearance and/or which is particularly well adapted for use in water skiing or the like. More specifically, it is an object of the present invention to provide a water ski tow rope handle which will rest comfortably in a skier's hands and/or which protects the tow line against chafing or abrasion.

The invention, together with additional objects, features and advantages thereof, will be best understood and appreciated from the appended claim, the following description and the accompanying drawings in which:

Figure 1:
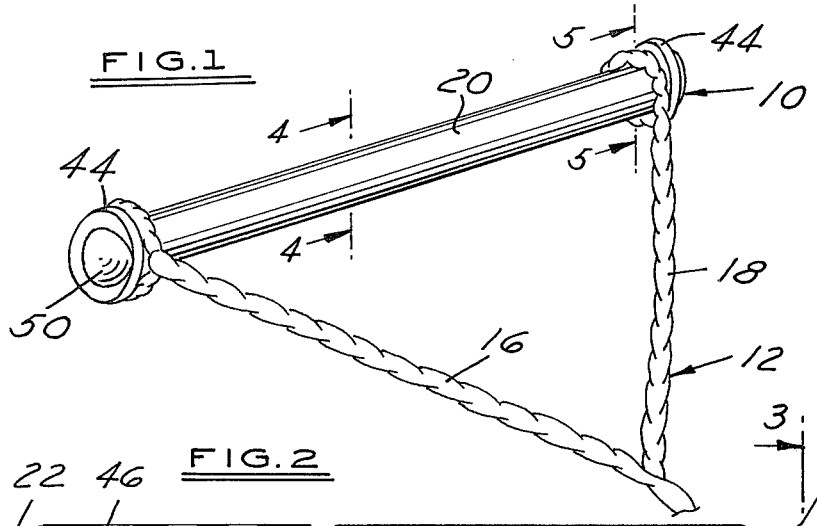
FIG. 1 is a perspective view of a presently preferred embodiment of the tow rope handle provided by the invention attached to a ski tow line.
Figure 2:
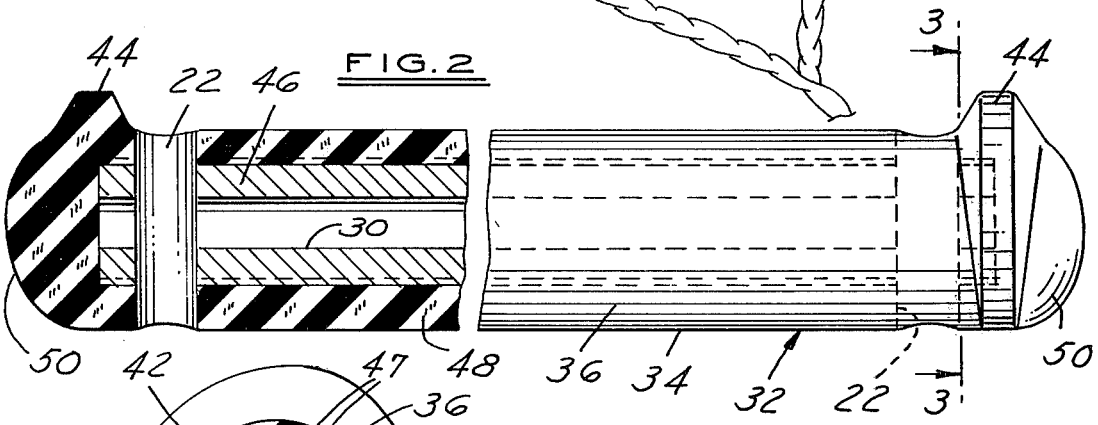
FIG. 2 is a plan view, partially in section, of the handle illustrated in FIG. 1.
Figure 3:
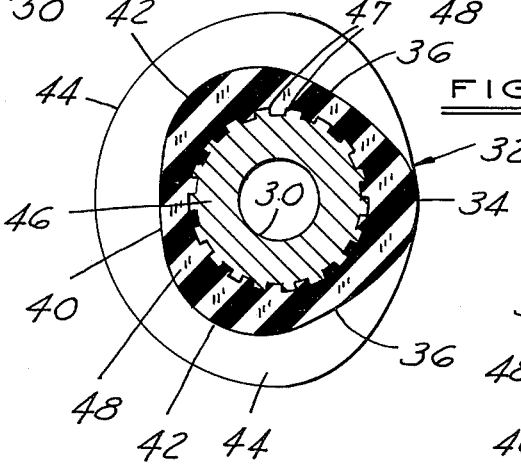
Figure 4:
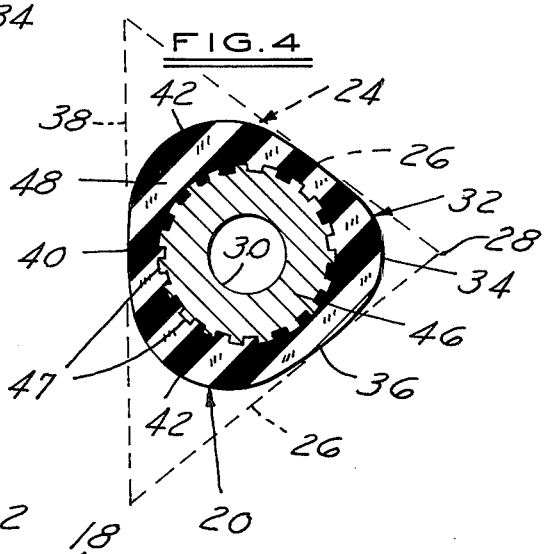
Figure 5:
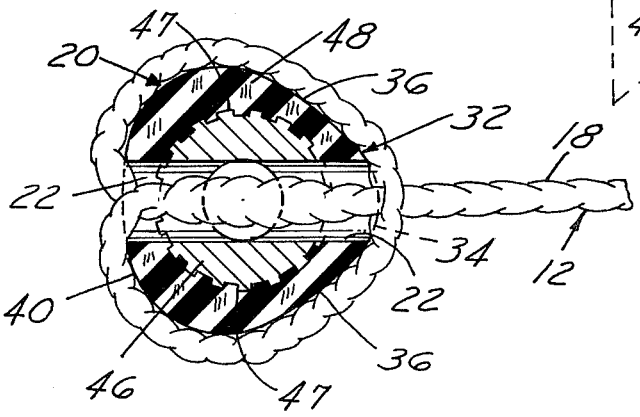

FIG. 3 is a sectional view of the tow rope handle taken along the lines 3—3 of FIG. 2; and FIGS. 4–5 are sectional views respectively taken along the lines 4—4 and 5—5 in FIG. 1.

Referring to the drawings, a tow rope handle 10 in accordance with the invention bridges and is connected to a y-shaped tow line 12 having an extended free end for connection to a ski tow boat or the like (not shown). Tow line 12 preferably comprises an extended integral length 14 of conventional hollow braided flexible thermoplastic material, such as nylon, connected at one end 16 to handle 10, and a shorter length 18 of similar material connected at one end to handle 10 and attached at the other end to length 14 to form the above-mentioned y-shaped configuration. Handle 10 comprises an elongated hand grip section 20 having a pair of holes 22 (FIG. 2) extending transversely therethrough near the hand grip ends.

As best seen in FIGS. 3–5, hand grip section 20 is substantially three sided in transverse cross section and bounded by a triangle 24 shown in phantom in FIG. 4. Preferably, triangle 24 is substantially isosceles having equal sides 26 which taper narrowingly in a direction parallel to holes 22 to form a vertex 28 radially aligned with the axis 30 of grip section 20 and extending lengthwise of the handle parallel to axis 30. A substantially V-shaped forwardly directed gripping surface 32 is thereby formed comprising a first arcuate portion 34 inwardly of vertex 28 with a radius of curvature radially offset from axis 30. Substantially flat gripping surface portions 36 extend from opposite edges of accurate portion 34 tangentially of axis 30 and contiguously with triangle sides 26. The base 38 of triangle 24 is longer than equal sides 26 and is tangentially contiguous to a rearwardly directed grip surface 40 connected to surfaces 36 by accurate surface edges 42. A pair of axially spaced circumferential ribs 44 are formed on handle 10 outwardly adjacent respective holes 22 to protect that portion of line 12 which encircles grip 20 from chafing or abrasion if the handle is dropped on a boat dock or the like. As best seen in FIG. 3, ribs 44 blend into the handle surface at the foreward edge 34 of the hand grip.

Thus, hand grip 20 is substantially triangular in transverse cross section with a generally V-shaped gripping surface 32 facing forewardly therefrom. In one embodiment of the invention shown to scale in the drawings, the radius of curvature of forward edge 34 is about thirty-eight percent of the overall distance between axis 30 and vertex 28. Gripping surface 32 nestles into the closed or partially closed configuration of a skier's hand and presents substantially planar contact surfaces 36 along the first and second phalanges, thereby providing a more comfortable distribution of the pulling force among the fingers. Furthermore, hand grip 20 facilitates alignment of a skier's wrist and forearm, thereby helping to prevent muscle strain that is possible if tow line 12 is suddenly pulled or jerked with the wrist locked. Although triangle sides 26 and, therefore, V-shaped gripping surface 32 may define a relatively wide range of included angles between surfaces 36 and still yield a uniform and comfortable distribution of the pulling force among the fingers, an included angle of 60° between the gripping surfaces is presently preferred. This angle is felt to correspond to the angle between the first and second phalanges of the average human hand when handle 10 is gripped with the wrist and forearm aligned with tow line 12.

Handle 10 is preferably formed as an integral unit comprising a hollow cylindrical metal tube 46 of extruded aluminum or the like coated with a relatively thick layer 48 of molded resilient material. Preferably, tube 46 is extruded with longitudinal ridges 47 extending over the outer surface thereof which cooperate with layer 48 molded thereon to retard relative rotation between the material layer and the tube substrate during use. Wooden inserts or the like (not shown) may be disposed within tube 46 to improve rigidity and flotation. To further retard rotation of the layer 48 on tube 46, a bonding agent is preferably disposed between the layer and tube. Layer 48 is preferably molded in situ on tube 46 with the bonding agent being disposed on the tube prior to the molding operation.

As best seen in FIGS. 2 and 5, holes 22 extend through metal tube 46. Preferably, the ends of tube 34 are closed by molded material, as best seen at 50 in FIG. 2. Hence, handle 10 can be formed in a single step molding operation. In one embodiment of the invention, material 36 comprises a rubber and cork mixture and provides a water-resistant non-slip gripping surface. The particular rubber/cork mixture has been used by Master Grip, Inc. of Wadsworth, Ohio for golf club grips. The method for attaching tow line 12 to handle 10 will be self-evident from reference to the above-noted Beck and Holland patents.

Although the invention has been shown and described as having a rounded forward edge 34, other configurations, such as a flat or planar forward edge parallel with triangle side 38, are also envisioned. Since the pulling force on the tow handle is distributed to the skier's hands along gripping surface 32, rear handle surface 46 is of lesser significance. However, the overall configuration shown in the drawings and described hereinabove having all rounded or accurate surfaces and edges is considered to be most economical and comfortable for a skier, and is therefore preferred. Similarly, discontinuities other than extruded ridges 47 may be formed on tube 46 for retarding rotation of casing 48 thereon, such as bosses, longitudinal undulations indentations or even holes in the tube surface into which molded material may extend. However, longitudinal ridges parallel to the tube axis are readily and economically formed during the tube-extrusion operation, and are therefore preferred. Moreover, such preferred ridges posses the additional advantage of being adaptable to a number of methods for placing casing 48 thereover, such as sliding a pre-formed casing axially over the tube or extruding the casing onto the tube. Molding the casing in situ is preferred.

The invention claimed is:

1. In a tow handle for water skiing or the like comprising an elongate hand grip adapted to be gripped encompassingly by a skier's hand and means on said hand grip for attaching a tow line to extend therefrom in a pulling direction transverse to the axis of said hand grip so as to define a gripping surface on a side of said hand grip facing in said pulling direction such that pulling force on said hand grip is transferred to a skier's encompassing hand along said gripping surface, the improvement wherein said gripping surface is substantially V-shaped in transverse cross section tapering narrowingly in said pulling direction so as to be adapted to be encompassingly gripped by a skier's hand with first and second finger phalanges extending along respective sides of said V-shaped gripping surface such that said pulling force is distributed over said gripping surface and substantially uniformly transferred to finger phalanges of a skier's hand.

2. The improved tow rope handle set forth in claim 1 wherein the forward edge of said V-shaped cross section is rounded.

3. The improved tow rope handle set forth in claim 1 wherein said handle is substantially triangular in transverse cross section, vertexes of said triangular cross section being rounded.

4. The improved tow rope handle set forth in claim 3 wherein said triangular cross section is substantially isosceles, equal sides of said substantially isosceles triangular cross section and the vertex therebetween bounding said substantially V-shaped cross section.

5. The improved tow rope handle set forth in claim 4 wherein said V-shaped cross section defines an included angle of substantially sixty degrees.

6. The improved tow rope handle set forth in claim 1 wherein said hand grip comprises a hollow aluminum tube with longitudinal ridges extending along the outer surface thereof and a resilient casing molded around said tube, said casing comprising a mixture of cork and rubber material.

7. The improved tow rope handle set forth in claim 1 wherein said means comprises parallel holes extending transversely through opposite ends of said hand grip such that said hand grip is adapted to receive a tow line having ends threaded through each hole and terminating in a loop firmly encircling said hand grip.

8. The improved tow rope handle set forth in claim 7 further comprising a pair of axially spaced circumferential ribs encircling said handle one adjacent each said transverse hole to protect said handle-encircling loops from abrasion.

9. The improved tow rope handle set forth in claim 1 wherein said hand grip is substantially three sided and bounded by a triangle in transverse cross section, said triangle having sides contiguous with surfaces of said handle and a vertex extending in said pulling direction.

10. The handle set forth in claim 9 wherein said triangle is substantially isosceles, said vertex being formed between equal sides of said triangle.

11. The handle set forth in claim 10 wherein edges of said substantially three sided hand grip at the vertexes of said triangle are rounded.

12. The handle set forth in claim 9 wherein said substantially triangular transverse cross section has a forward edge disposed radially inwardly of said vertex.

13. The improved tow rope handle set forth in claim 1 wherein said V-shaped gripping surface is defined by an arcuate portion having a radius of curvature offset from the axis of said grip and substantially flat portions extending from opposite edges of said arcuate portion tangentially of said axis.

* * * * *